US011723483B2

(12) United States Patent
Morelock et al.

(10) Patent No.: US 11,723,483 B2
(45) Date of Patent: Aug. 15, 2023

(54) DRINK SET HAVING A CALMED AND RESTRICTED FLUID FLOW

(71) Applicants: David M Morelock, Escondido, CA (US); Joedin D Morelock, Escondido, CA (US); Richard C Yang, Carlsbad, CA (US)

(72) Inventors: David M Morelock, Escondido, CA (US); Joedin D Morelock, Escondido, CA (US); Richard C Yang, Carlsbad, CA (US)

( * ) Notice: Subject to any disclaimer, the term of this patent is extended or adjusted under 35 U.S.C. 154(b) by 19 days.

(21) Appl. No.: 17/026,676

(22) Filed: Sep. 21, 2020

(65) Prior Publication Data

US 2021/0212486 A1 Jul. 15, 2021

Related U.S. Application Data

(60) Provisional application No. 62/903,882, filed on Sep. 22, 2019.

(51) Int. Cl.
*A47G 19/22* (2006.01)

(52) U.S. Cl.
CPC ..... *A47G 19/2272* (2013.01); *A47G 19/2288* (2013.01)

(58) Field of Classification Search
CPC ..... A47G 19/2272; A47G 19/2288; A47G 19/2266; A47G 19/2205; A47G 23/032; A47G 2023/0291; B65D 47/043; B65D 47/04; B65D 81/3876; B65D 81/3879; B65D 81/3881; B65D 81/3883; B65D 81/3886
USPC .... 220/710.5, 711, 714, 719, 253, 580, 578, 220/729, 737, 740
See application file for complete search history.

(56) References Cited

U.S. PATENT DOCUMENTS 2,529,114 A * 11/1950 Tellier ..... A47G 19/2272 138/40
3,313,447 A * 4/1967 Spencer ..... B65D 1/265 D7/510
3,360,161 A * 12/1967 Smith ..... A47G 19/2272 D7/396.2
5,339,981 A * 8/1994 Kral ..... B44D 3/12 220/287
5,531,353 A * 7/1996 Ward ..... A47J 41/0083 220/729

(Continued)

*Primary Examiner* — James N Smalley
*Assistant Examiner* — Madison L Poos

(57) ABSTRACT

Briefly, a drinking set is provided that has a cup and a flow control disk set fully inside the cup. The flow control disk is constructed for creating a tortured flow path for any fluid flowing out of the cup. In this way, spills are substantially reduced or minimized, and the user has a stable and predictable sipping experience, even when the cup is jostled or violently moved. Fluid moving from the cup first hits a set of steeply angled entry fins, which absorb or reflect energy in the fluid. The fluid passes through a set of small entry openings, and flow to a set of exit fins, where the fluid strikes a face of the exit fins and changes direction to a set of larger exit openings. This tortured fluid path causes the drinking fluid to have a controlled flow and reduced kinetic energy as it approaches the user's mouth, multiple changes in flow direction, and provides several obstacles for absorbing kinetic energy and thus slowing the flow of the fluid.

22 Claims, 13 Drawing Sheets

(56) References Cited

U.S. PATENT DOCUMENTS

| | | | | |
|---|---|---|---|---|
| 6,488,173 | B2 * | 12/2002 | Milan | A47G 19/2272 220/255 |
| 8,267,275 | B2 * | 9/2012 | Peitersen | B65D 47/06 229/404 |
| 8,444,004 | B1 * | 5/2013 | Draganic | A47G 19/2205 220/734 |
| 9,820,594 | B2 * | 11/2017 | Bower | A47G 19/2261 |
| 2006/0249521 | A1 * | 11/2006 | Dark | A47G 19/2272 220/717 |
| 2016/0145011 | A1 * | 5/2016 | Savel | B65D 47/043 53/436 |
| 2021/0068520 | A1 * | 3/2021 | Chung | A47G 19/2272 |

* cited by examiner

DRINK SET HAVING A CALMED AND RESTRICTED FLUID FLOW

RELATED APPLICATIONS

This application claims priority to U.S. provisional application No. 62/903,882, filed Sep. 22, 2019, and entitled "Drink Set Having a Calmed and Restricted Fluid Flow", which is incorporated herein in its entirity.

FIELD OF THE INVENTION

The field of the present invention is physical drinking vessels and lids, and more particularly a drinking vessel and lid for providing a calmed and reduced fluid flow. In one example, the drinking vessel is constructed to hold a hot fluid such as coffee or tea.

BACKGROUND

People have been drinking from cups for thousands of years, and for all those thousands of years have been struggling to keep the fluid in the cup when the cup is jostled around. A particularly difficult problem is drinking a hot fluid, such as coffee, while driving or riding in a passenger car. Just as the cup reaches the drinker's lips, all too often the driver suddenly stomps on the brakes, hits a bump, or swerves. The energy from these sudden motions transfers to the cup and its coffee, and the coffee becomes highly energetic and agitated, sloshing within the cup, and spilling out over the rim onto the person trying to take a sip or onto the car. These spills not only can be expensive, needing professional cleaning for clothes and the car's interior, but can be uncomfortable, painful, or even dangerous if the coffee is too hot. Further, even if the bump was insufficient to cause a spill, the bump can ruin the sipping experience, and make the sipper apprehensive in trying to take another sip.

Over the years, many inventors have tried to solve this problem, using various screens, lids or baffles to keep the fluid from spilling out of the cup when the cup is bouncing around. But nothing has proven successful. Although some designs may reduce the tendency to spill out of the cup, these designs do so at the expense of a negative and undesirable sipping experience. No one has made a cup and lid design that can both control the fluid in the cup so that it does not slosh out and spill, while at the same time enabling a comfortable and confident sipping experience, even when its bumpy. Many designs are also so complicated as to be impractical or too expensive to effectively make and market, or present cleaning and sanitation problems.

SUMMARY

A drinking set is described that is easy to clean, sanitary, and practical to make and market. The drinking set so effectively controls the (1) volume, (2) flow and (3) energy of the drinking fluid that it is nearly impossible to slosh the fluid out of the cup, even in hard braking or swerving emergencies. And importantly, even when the cup is bouncing about, it provides a consistent and expected fluid flow to the drinker's lips. In this way, the drinker is presented with an enjoyable sipping experience, and can confidently take that next sip.

A drinking set has a cup and a flow control disk set fully inside the cup. The flow control disk is constructed for creating a tortured flow path for any fluid flowing out of the cup. In this way, spills are substantially reduced or minimized, and the user has a stable and predictable sipping experience, even when the cup is jostled or violently moved. Fluid moving from the cup first hits a set of steeply angled entry fins, which absorb or reflect energy in the fluid. The fluid passes through a set of small entry openings, and flow to a set of exit fins, where the fluid strikes a face of the exit fins and changes direction to a set of larger exit openings. This tortured fluid path causes the drinking fluid to have a controlled flow and reduced kinetic energy as it approaches the user's mouth, multiple changes in flow direction, and provides several obstacles for absorbing kinetic energy and thus slowing the flow of the fluid.

In one example, the drinking set is constructed for a user to drink a beverage such as coffee or tea. A cup has a rigid sidewall and is sized, for example, to set into a cup holder of a vehicle. A step protrusion is positioned on an inner wall of the cup such that the inside diameter is larger above the step protrusion and the inside diameter is more narrow below the step protrusion. Preferably, the cup is constructed of an insulating material to assist keeping the fluid in the cup either hot or cold. A flow control lid can be inserted into the cup and sets against the step protrusion. The flow control lid is preferably constructed as a unitary piece, and may be molded from silicone. The flow control lid is generally a disk having a convex dome. The top surface of the dome is smooth to facilitate ease of cleaning and fluid flow. A set of lower entry fins extends from the base of the dome at a steep angle toward the inner sidewall below the step protrusion. The lower entry fins do not contact the sidewall, but have a clearance fit. These lower entry fins initially engage the sloshing fluid as the fluid attempts to exit the cup. The angle of the entry fins is such that some of the energy from the agitated fluid is absorbed in the entry fins, and some is reflected back into the cup. Thus, these lower entry fins act to reduce the level of kinetic energy in the fluid, thereby substantially reducing the risk of fluid splashing out of the cup.

Further, a set of upper fins is integrally formed in the top surface of the dome, which are sized to set on to the step protrusion and frictionally engage the sidewall above the step protrusion. The upper fins are positioned such that fluid that flows from between the lower entry fins strikes the center of each upper exit fan, thereby causing the fluid to change direction. This further absorbs energy and calms the fluid flow. The lower entry openings are substantially smaller than the upper exit openings, and the two sets of openings cooperate to dramatically reduce fluid flow from within the cup to the cup's rim, while still maintaining sufficient flow to support an enjoyable drinking experience.

The drinking set may also have a silicone cover, which in one use can cover the top to provide additional spill resistance, as well as further insulation and odor control. The cover has a flexible top, such that when depressed, air is forced from the cup, thereby creating a vacuum seal between the cover and the cup. The cover and cup are also sized so that the base of the cup may be set into cover, thereby providing a slip resistant base to the cup while in use.

Advantageously, the drinking set is substantially spill proof, and provides a consistent, predictable, and enjoyable sipping experience for the user. Further, the drinking set is sanitary and easy to clean, and will provide years of service. As the flow control lid is a unitary piece of silicone, it is easy and inexpensive to manufacture.

BRIEF DESCRIPTION OF THE DRAWINGS

These and other objects and advantages of the invention will become apparent upon reading the following detailed description and upon referring to the drawings and claims.

While the invention will be described in conjunction with example embodiments, it will be understood that it is not intended to limit the invention to such embodiments. On the contrary, it is intended to cover all alternatives, modifications and equivalents as may be included within the spirit and scope of the invention. It will be understood that the drawings are exemplary, and may not be to scale or may have certain features removed to improve understandability.

DESCRIPTION

Figure 1:
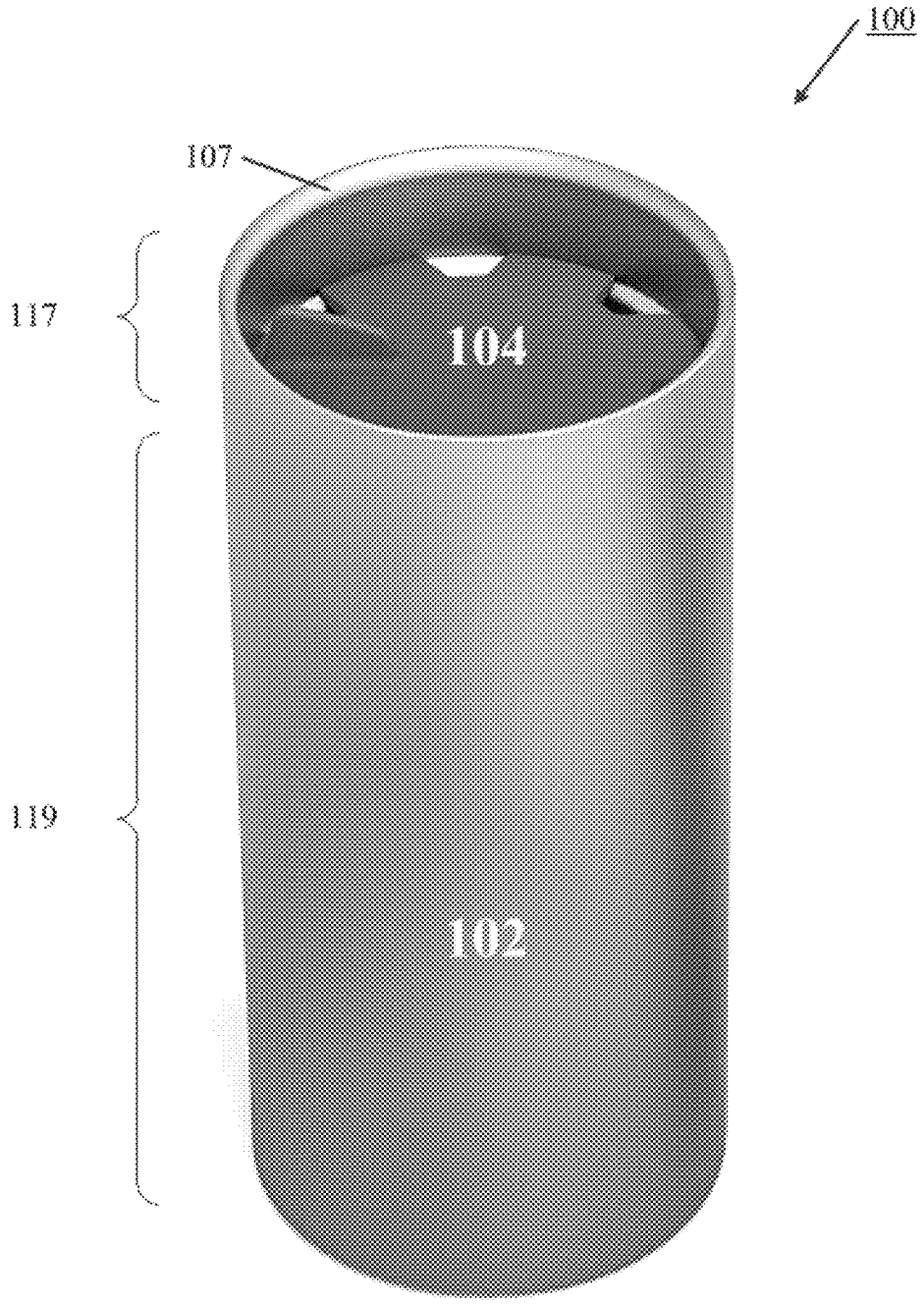
FIG. 1 is an isometric illustration of a drinking set in accordance with the present invention.

Referring now to FIG. 1, a drinking set 100 is illustrated. Drinking set 100 is intended to hold and dispense a fluid for human consumption. Drinking set 100 is designed to allow a user to have a pleasant sipping experience, even when the user and cup are being jostled or bounced about, for example, when the user is a passenger in a car having a bumpy ride. Due to the particularly effective flow control provided by the drinking set 100, the user may sip confidently, with minimal risk or fear of spilling. Drinking set 100 may be used for a wide variety of fluids, both hot and cold. For example, the drinking set may be used for coffee or tea, both hot and iced, or may be used for water, juices, milk, or other such liquids.

As will be described in detail below, drinking set 100 provides a tortured fluid path for any fluid moving from inside the cup 102 to a user attempting to sip liquid from the cup's rim 107. This tortured fluid path causes the drinking fluid to have a controlled flow and reduced kinetic energy as it approaches the user's mouth, multiple changes in flow direction, and provides several obstacles for absorbing kinetic energy and thus slowing the flow of the fluid. In this way, fluid that is in a highly chaotic and energetic in the cup 102 is calmed as it approaches the user's mouth. For example, during a rough airplane or car ride, the fluid in the cup 102 will be calmed such that it would be highly unlikely to spill out of the flow control lid 104. Advantageously, even in rough conditions, the user can confidently drink from the cup as the flow control lid 104 will always provide an expected amount of fluid flowing at an expected velocity and volume. More particularly, the internal inertial structures and internal openings have been carefully sized, angled, and positioned to assure that undesirable energy has been removed and redirected from fluid before it exits the flow control lid 104.

Drinking set 100 has a cup 102 and a flow control lid 104 that sits completely inside the cup 102. More particularly, the cup 102 has a head space 117 sized to contain the top of the flow control lid, as well as provide sufficient interior sidewall space for a comfortable sipping experience. The user sips by placing his or her lips on the cup rim 107, and tipping the cup 102 such that the fluid in the fluid area 119 flows toward the flow control lid 104 and to the cup rim 107.

Drinking set 100 may be provided in various sizes, for example a 500 ml version and a 300 ml version. In one particularly desirable construction, the drinking set 100 is size such that it may be conveniently and securely set in an automobile cup holder. It will be appreciated that many different sizes and shapes can be used consistent with this disclosure.

Figure 2:
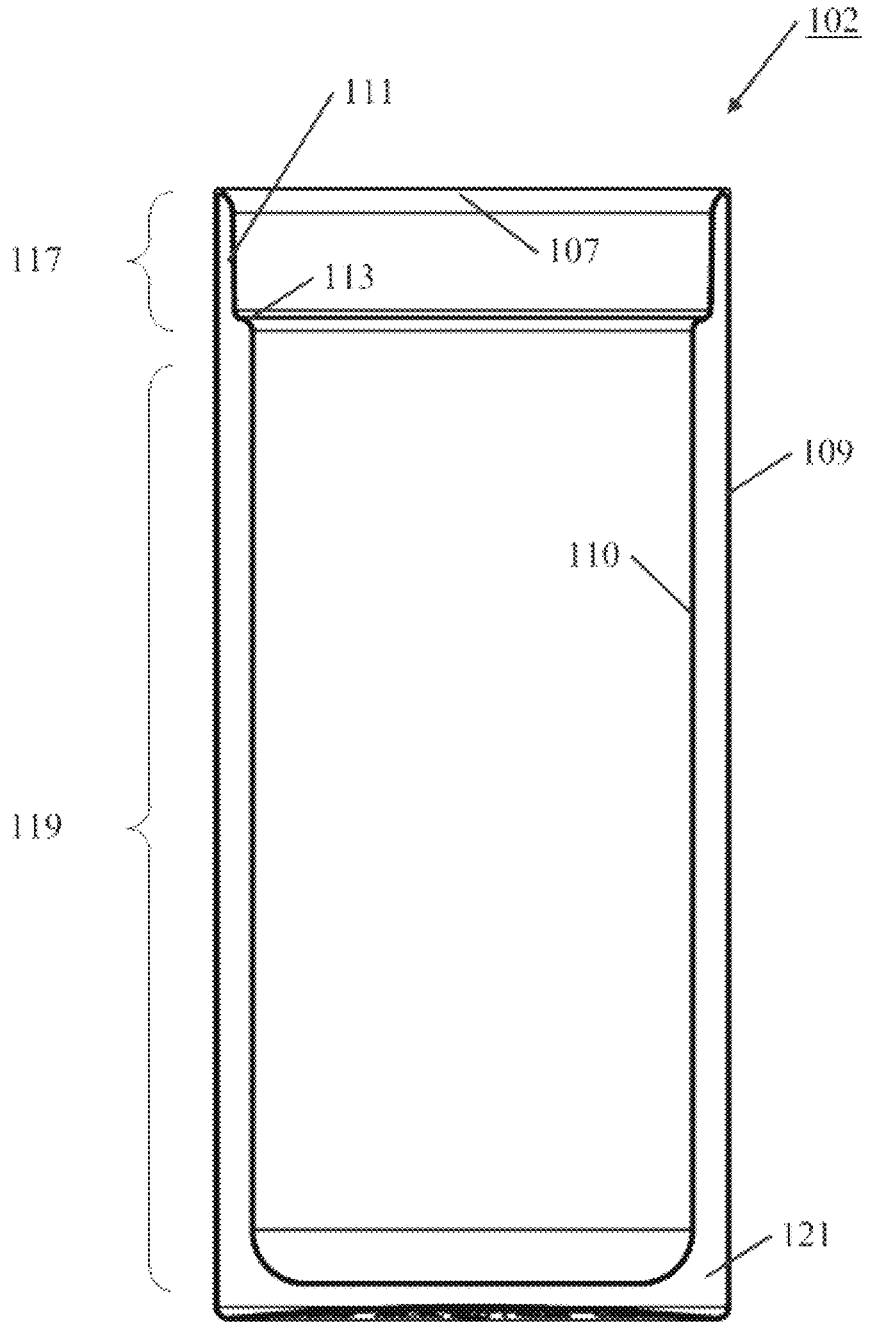
FIG. 2 is a cross sectional view of a cup for use with a drinking set in accordance with the present invention.

Referring now to FIG. 2, the cup 102 is illustrated. Cup 102 is a vessel for holding a drinkable fluid such as coffee or tea. It is generally in the shape of an elongated cylinder, and has a bottom 121, an outer sidewall 109, and inner sidewalls 110 and 111, and a cup rim 107. The inner sidewall has a step protrusion 113 located between the head area 117 and the fluid area 119. This step protrusion 113 is smooth and gently sloped, and is solid around the entire circumference of the inner walls 110 and 111. Although the step protrusion 113 is shown with the inner wall 110 having a smaller diameter below the step protrusion than an upper portion 111, it will be understood that step protrusion 113 could be constructed as a ridge. In this way, the sidewall 110 could be constructed with the same diameter in the head room area 117 as in the fluid area 119.

Cup 102 may be constructed of various types of materials. Generally, the cup 102 should provide rigid sidewalls 109 and desirably should be constructed of a material that provides some level of insulating effect. For example, cup 102 may be constructed from a plastic material, a ceramic material, a glass material, a metal or metal alloy material, a composite material or even a rigid paper material. It will be understood that cup 102 may be constructed with various heights, diameters, and volumes. In one particularly useful example, the outer wall 109 has a diameter selected such that cup 102 may be received into a cup holder of a car or other vehicle.

Figure 3A:
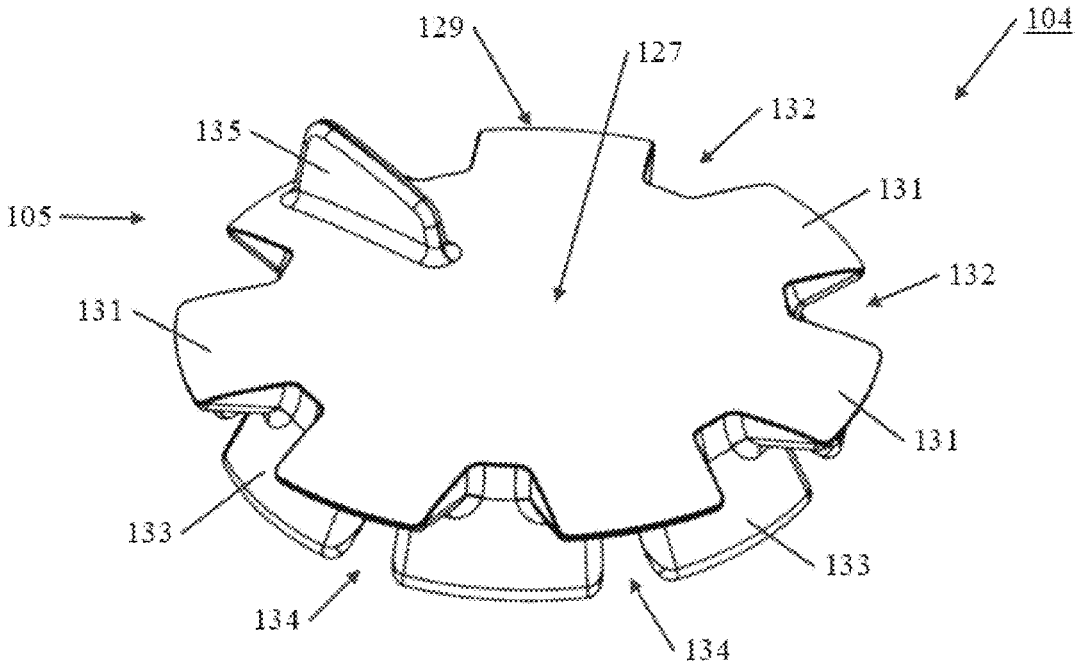
FIG. 3A is an isometric drawing of a splash lid for use with a drinking set in accordance with the present invention.
Figure 3B:
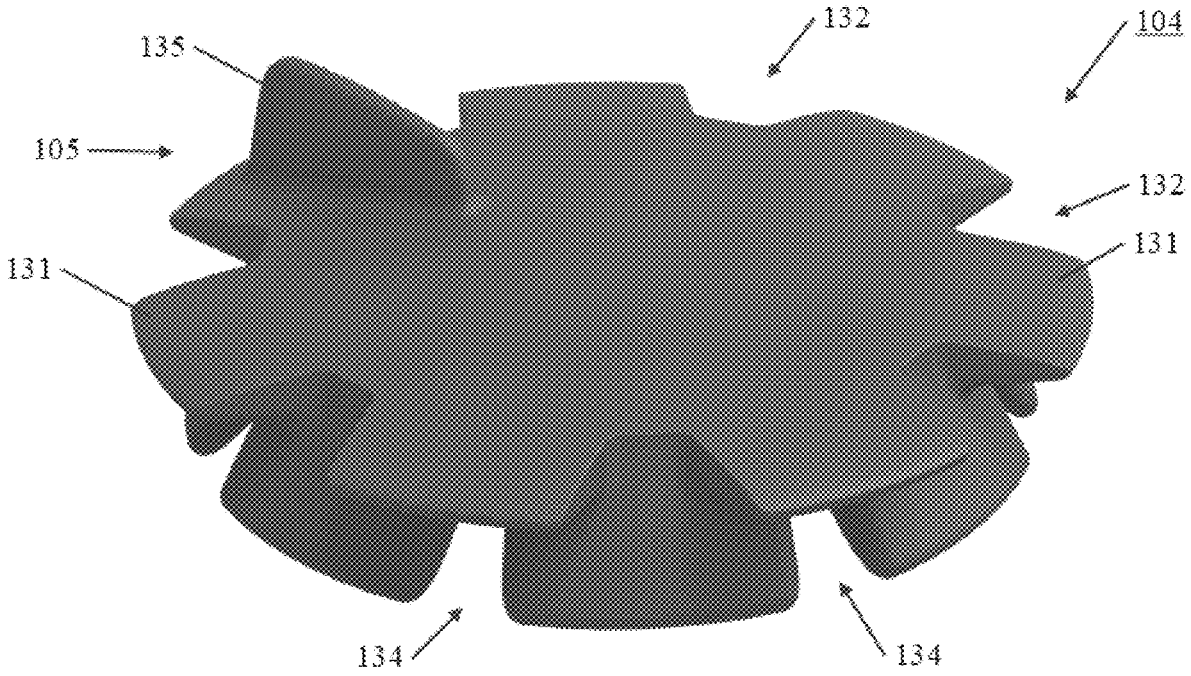
FIG. 3B is an isometric illustration of a splash lid for use with a drinking set in accordance with the present invention.
Figure 3C:
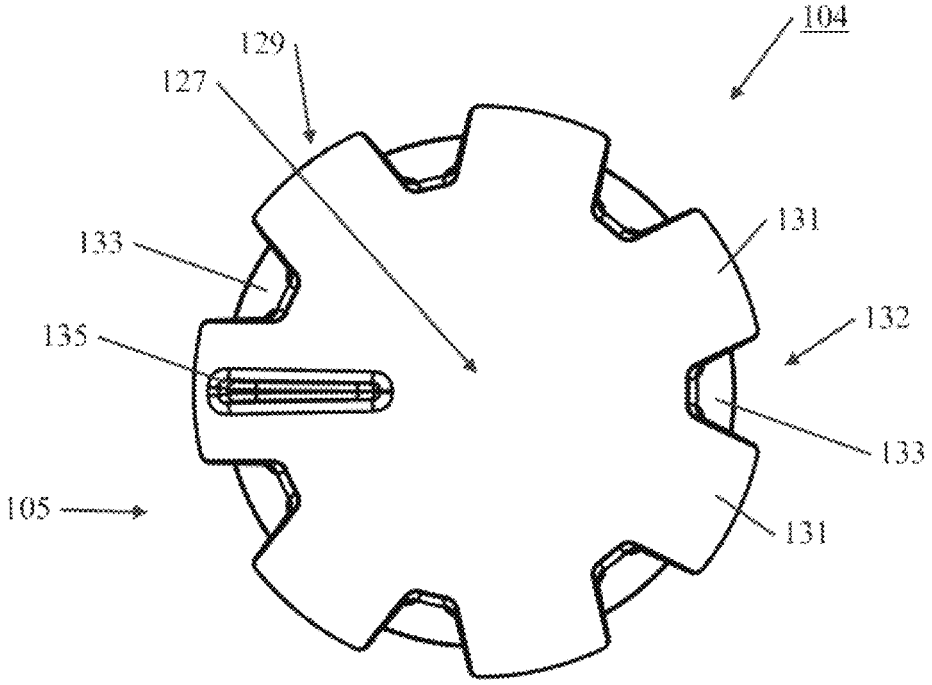
FIG. 3C is a top view of a splash lid for use with a drinking set in accordance with the present invention.

Referring now to FIG. 3A, FIG. 3B and FIG. 3C, a flow control lid 104 is illustrated. Flow control lid 104 is constructed as a unitary disk 105. In this way, disk 105 is molded or constructed as a single piece, facilitating ease of cleaning, bacterial resistance, superior insulating properties, as well as increasing structural integrity. Disk 105 has a domed top 127 that has a convex slope from its center point to the outer edge 129 of the disk 105. Toward the outer edge 129 of disc 105 a set of spaced apart upper or exit fins 131 are integrally formed into the disk 105. As illustrated, 7 exit fins 131 are provided in the disk, with the top of exit fins 131 forming a portion of the top face of the convex dome. It will be understood that fewer or more exit fins may be used. Exit openings 132 are created in the voids between adjacent exit fins 131, and provide a space where fluid can exit the flow control lid 104 toward the cup rim 107. As will be described later, when cup 102 is tipped, fluid is allowed to flow through the exit openings 132 toward the cup rim 107, and to the user's lips. Each of the exit openings 132 its widest at the outer edge of the desk, and become more narrow toward the center of the disc. In one specific example, each of the exit openings 132 is generally trapezoidally shaped. By having the widest part of the exit opening towards the inner wall 111, any fluid flowing towards the user will be concentrated closer to the inner sidewall 111, reducing the chance of spilling and keeping fluid closer to the sidewall. The disk 105 is constructed of a flexible material such as a silicone. To increase structural integrity, disk 105 is thicker towards the center of the disc, and thinner towards the outer edge 129 of exit fins 131. Exit fins 131 are tapered such that they are thinnest towards the edge of the disk 129, thereby facilitating sufficient flexibility to frictionally engage upper sidewall 111.

Lower or entry fins 133 extend from the bottom of the disc 105 at an angle toward the lower side wall 110 of the cup. Entry openings 134 are created in the voids between adjacent entry fins 133. When the dome 105 is set in a horizontal position, as it would be if the cup 102 is on a flat horizontal surface, then the entry openings 134 are positioned directly below and centered beneath a respective fin 131. Typically, the number of entry openings will equal the number of upper fins. Further, entry openings 134 are substantially smaller than the exit openings 132. As illustrated, the outer face of each entry fin 133 forms a portion of the back wall of a respective exit opening 132, thereby increasing structural integrity, and creating exposed surfaces that are easy to clean.

Disk 105 may also have a handle 135 integrally formed into its top domed surface 127. It will be understood that many alternative shapes may be used for handle 135 consistent with this disclosure. As will be discussed in more detail later, the entire flow control lid 104, including the handle 135, is intended to fit completely inside the cup 102, with none of the flow control lid 104 extending above the cup rim 107.

Figure 3D:
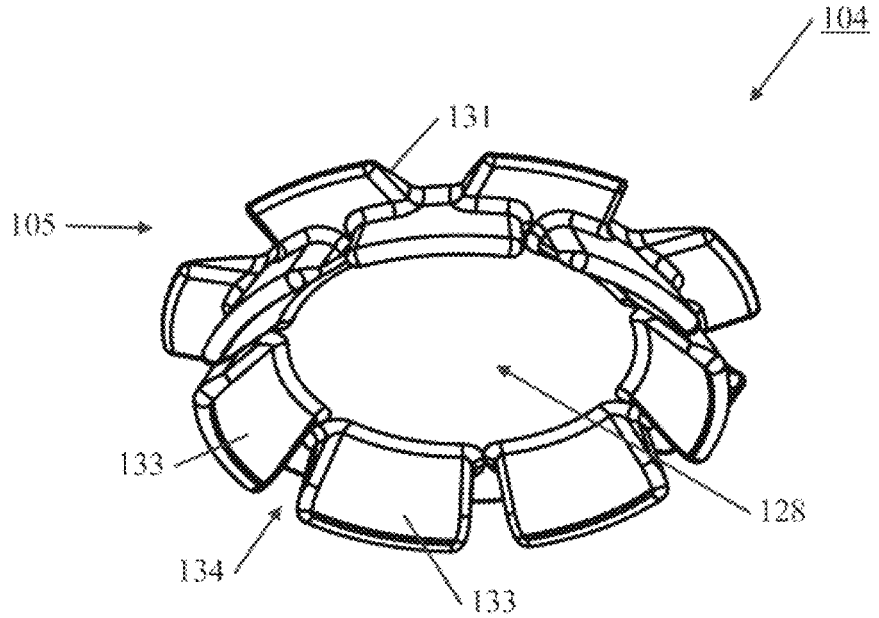
FIG. 3D is an isometric bottom view of a splash lid for use with a drinking set in accordance with the present invention.

Referring now to FIG. 3D, the disk 105 is illustrated from a bottom view. In this orientation, it can be clearly seen that the disk 105 has a solid circular center portion 128 from which both the upper exit fins 131 and the lower entry fins 133 extend. The exit fins 131 extend from the solid center in a way that provides a smooth convex top surface to the disk 105, with the fins 131 being thicker toward the center portion 128 and thinner towards the outer edge 129 of disk 105. Entry fins 133 also extend from the center portion 128, and extend in a way such that a face of each entry fin 133 is integrally formed into a back wall of a respective exit opening 132.

Figure 3E:
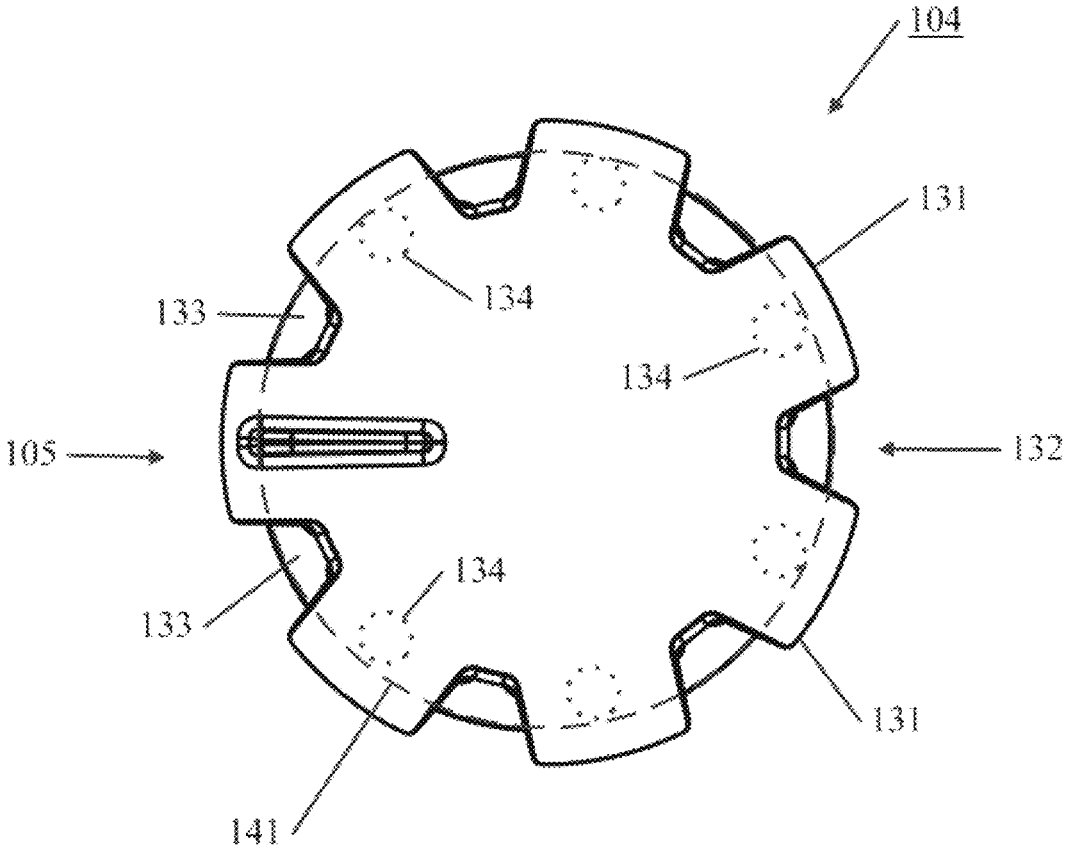
FIG. 3E is a top view of a splash lid for use with a drinking set in accordance with the present invention.

Referring now to FIG. 3E, a top view of the flow control disk 104 illustrates that the entry openings 134 are centered directly beneath a respective upper fin 131. Also, entry openings 134 are substantially smaller than exit openings 132. In one example, the entry openings are about half the area of the exit openings. In one specific example, the entry openings are about 50 mm2, and the exit openings are about 90 mm2. It will be appreciated that other ratios and sizes may be used consistent with this disclosure.

In one very specific example, flow control lid 104 is a molded single piece of medical grade silicone. It has 7 equally-spaced exit fins 131 forming 7 exit openings 132, and 7 equally-spaced entry fins 133 forming 7 entry openings 134. The dome 105 is about 73 mm in outside 129 diameter with a thickness at its center of about 7.3 mm. The exit openings are about 14 mm wide at the outer edge 129 of the disk 105, and about 6.5 mm wide at the exit opening's 132 back wall. This makes the exit opening 132 generally trapezoidal shaped with side walls forming about a 51 degree angle. The front face of each entry fin 133 extends from the back wall of each respective exit opening 132. The front face of the entry fin 133 extends from the bottom 128 of the dome at about a 60 degree angle, and extends to a point that is about 3.2 mm inside the outer diameter 129. In this way, the entry fin 133 forms a clearance fit with the lower inner wall 110 of the cup 102. The entry fins 133 are thicker toward the dome 105 and thinner towards the sidewall 110, generally having a taper of about 15 degrees. From a side view perspective, the entry fins 133 extend about 7.7 mm below the bottom 129 of the disk 105. Although specific dimensions are provided for this example, it will be appreciated that these dimensions can be modified, and are provided only to facilitate understanding of the structural relationships as claimed.

Figure 4A:
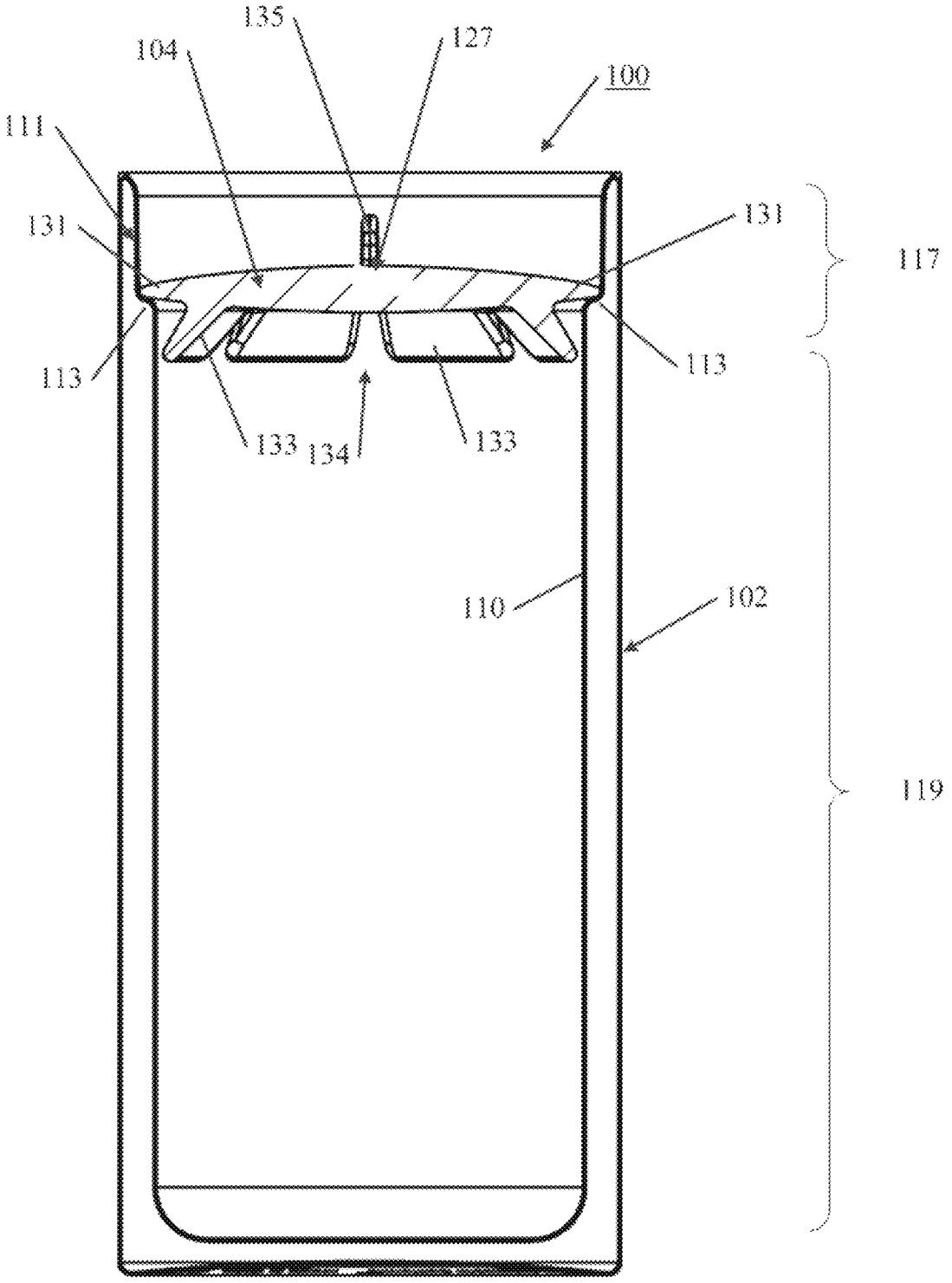
FIG. 4A is a cross sectional view of a drinking set in accordance with the present invention.

Referring now to FIG. 4A, the drinking set 100 is illustrated in a cross-sectional view. Drinking set 100 includes the cup 102 with the flow control lid 104 inserted into headspace 117 such that the exit fins 131 rest against step protrusion 113, and the exit fins 131 are frictionally retained against inner sidewall 111. In this way, the flow control disk 104 is securely held within cup 102, but may be easily removed when desired. The disk 105 is dome-shaped with a smooth convex surface such that center 127 is higher than outer edge 129. In this way, when cup 102 is oriented horizontally on a flat surface, any stray fluid in the headspace 117 would flow toward the sidewall 111 and pass through the exit openings 132 into the fluid area 119. Thus, the top of the fluid control disk 104 does not allow undesirable fluid to collect, which could surprise a person taking a drink.

Figure 4B:
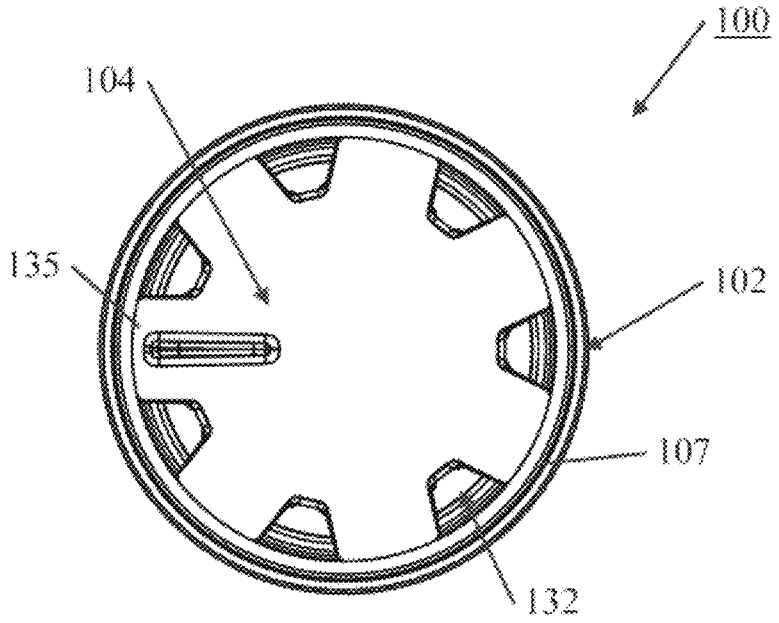
FIG. 4B is a top view of a drinking set in accordance with the present invention.

Lower entry fins 133 extend from the bottom of the fluid control disk 104 at a steep angle toward the inner sidewall 110. The steep angle not only increases structural integrity of the overall disk 105, but acts to redirect inertial energy from any fluids sloshing about in the fluid area 119. Entry fins 133 preferably do not contact the inner wall 110, but have a slight clearance fit for allowing easy insertion. The entry fins 133 have a small clearance fit to the sidewall 110, this small clearance is important to ease insertion for the user, FIG. 4B shows drinking set 100 with the flow control disk 104 inserted into cup 102. When viewed from the top, the exit openings 132 are visible, from which fluid will exit when the cup is tipped toward the user. The entry openings 134 are not visible from this top view as they are located centered and directly below each respective upper exit fin 131.

Figure 4C:
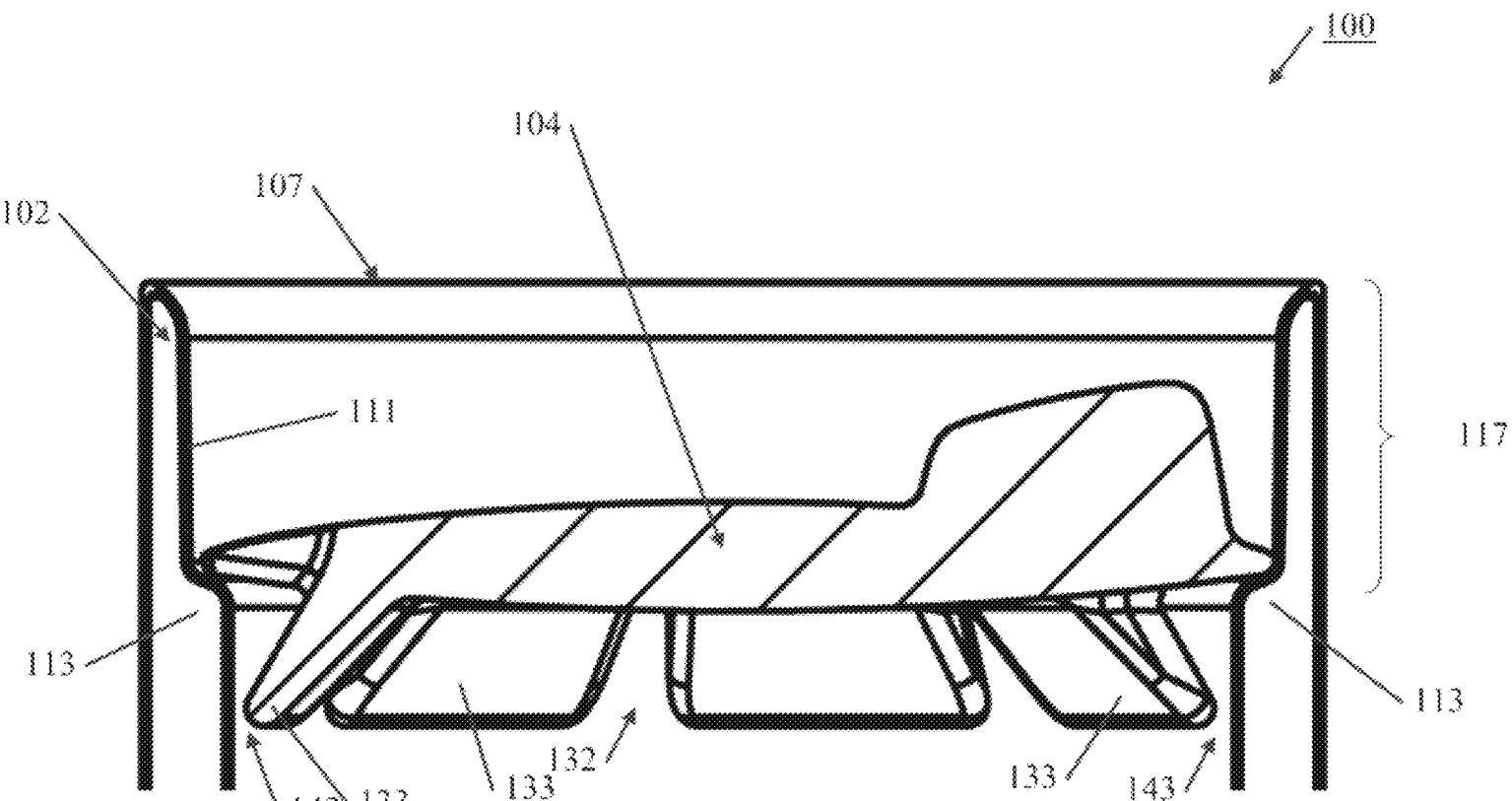
FIG. 4C is an enlarged cross sectional view of the top of a drinking set in accordance with the present invention.

FIG. 4C is an enlarged view of the drinking set 100 near the head area 117, showing the cup 102 with the flow control lid 104 installed. The cup 102 has an upper sidewall 111 that extends through the headspace 117 and narrows the cup's diameter at step protrusion 113. In this way, the diameter of the cup 102 is slightly larger in the headspace 117 than in the fluid area 119. In this way, the flow control disk 104 may be easily inserted into the headspace such that the exit fins 131 can rest on the step protrusion 113 and are frictionally retained against sidewall 111, while the entry fins 133 can easily pass into the fluid area and have a clearance fit with the narrowed sidewall 110. In this way, the flow control did 104 is easy to insert into cup 102. Also, flow control lid 104 is completely contained within the cup, that is, positioned below the cup rim 107.

Figure 5A:
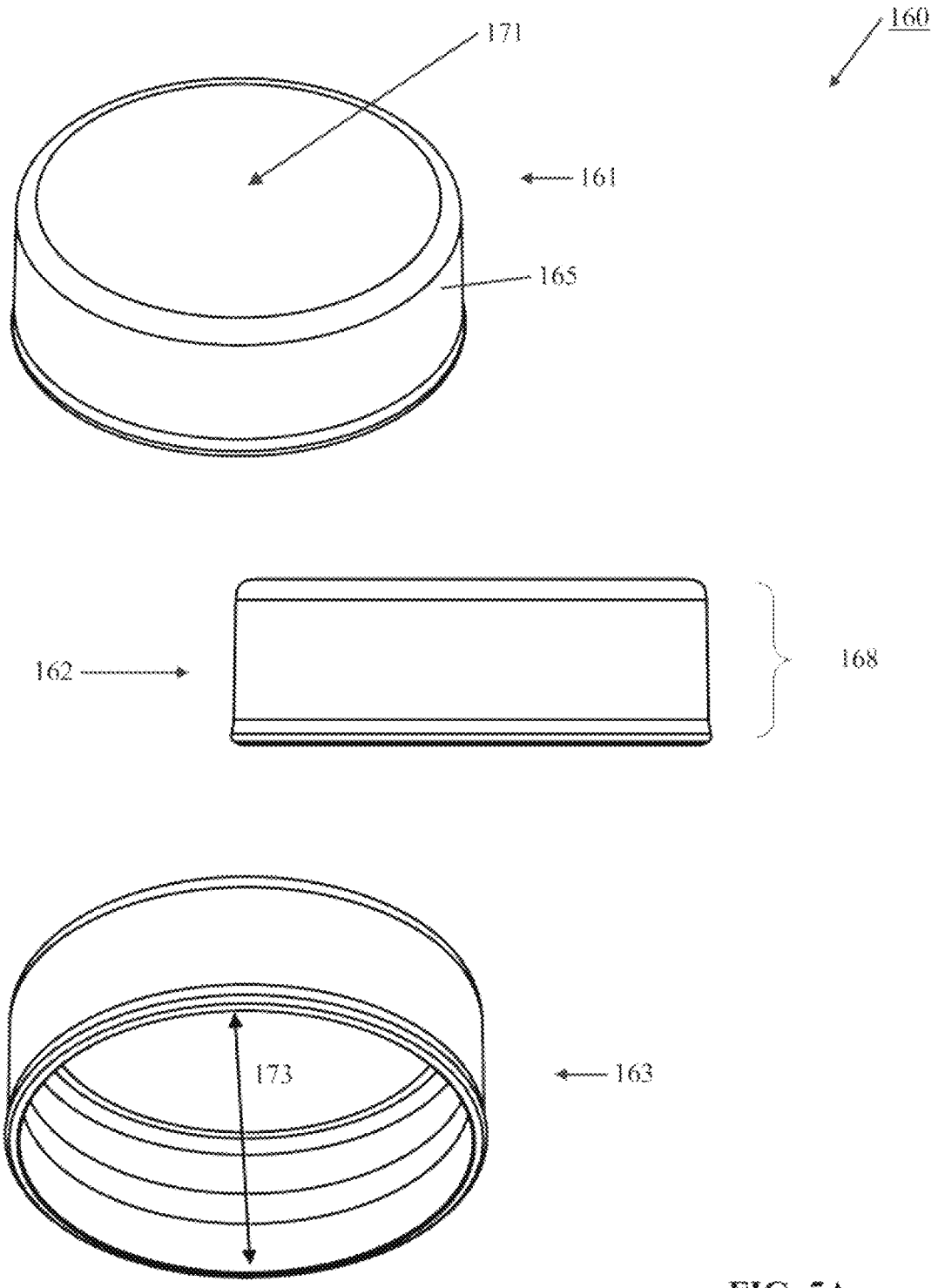
FIG. 5A is a cover for use with a drinking set in accordance with the present invention.
Figure 5B:
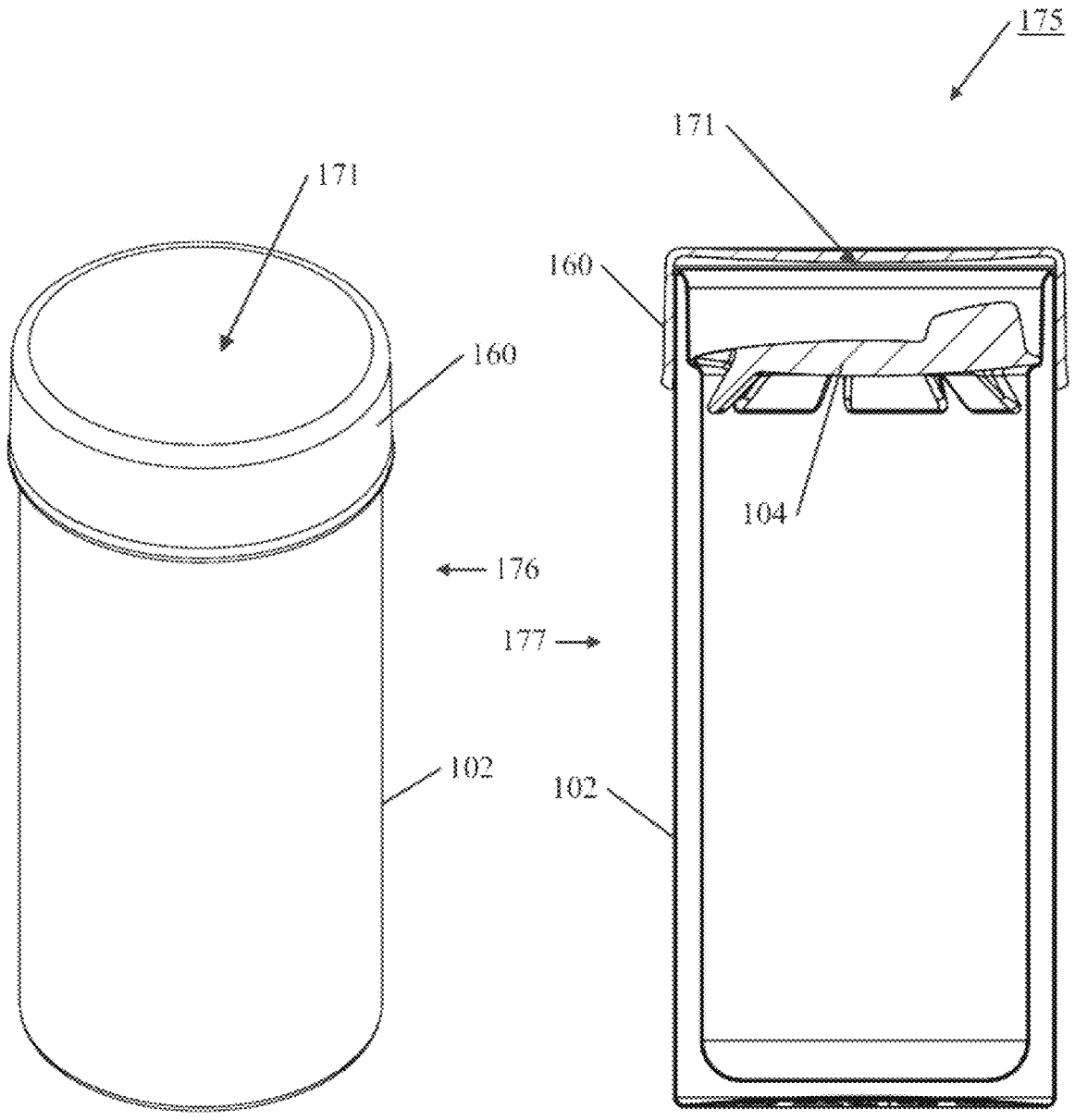
FIG. 5B shows a cover sealing the top of a drinking set in accordance with the present invention.

Referring now to FIG. 5A, an accessory cover 160 for drinking set 100 is illustrated. Cover 160 is illustrated as a top view 161, a side view 162, and a bottom isometric view 163. Cover 160 is constructed as a unitary molded flexible piece having an inside diameter 173 sized to fit over the outside diameter of an associated cup 102 for drinking set 100. The sidewall 165 for the cover 160 has a height 168 such that when installed the cover sidewall extends below the step protrusion 113 for cup 102. The top surface of the cover is flexible, such that the center 171 can be depressed, reducing the volume within cover 160. Cover 160 is illustrated installed over the opening of cup 102 in FIG. 5B. The drinking set 100 is illustrated with cover 160 installed in an isometric view 176 and a cross-sectional view 177. As illustrated, cover 160 extends below step protrusion 113. If a user depresses the top surface 171 of cover 160, air within the fluid space 119 will be slightly pressurized, and escape between the flexible side wall of the cover 160 and the rigid sidewall 109 of the cup 102. When the user releases pressure on top surface 171, the flexible sidewall of the cover 160 will seal against the rigid sidewall 109 of cup 102, thereby providing a vacuum seal inside fluid area 119. The sealing not only assists in reducing or eliminating any splashing when covering cup 102, but the cover also aids in insulating the fluid, and keeping any odors from the fluid inside cup 102. To remove cover 160, the user simply releases the vacuum seal by pulling the flexible sidewall of cover 160 away from the cup sidewall 109, which releases the vacuum, and a cover 160 may be readily removed. As illustrated, the cover sets against the cup rim 107, with the flow control lid 104 set below the top surface 171 of cover 160.

Figure 5C:
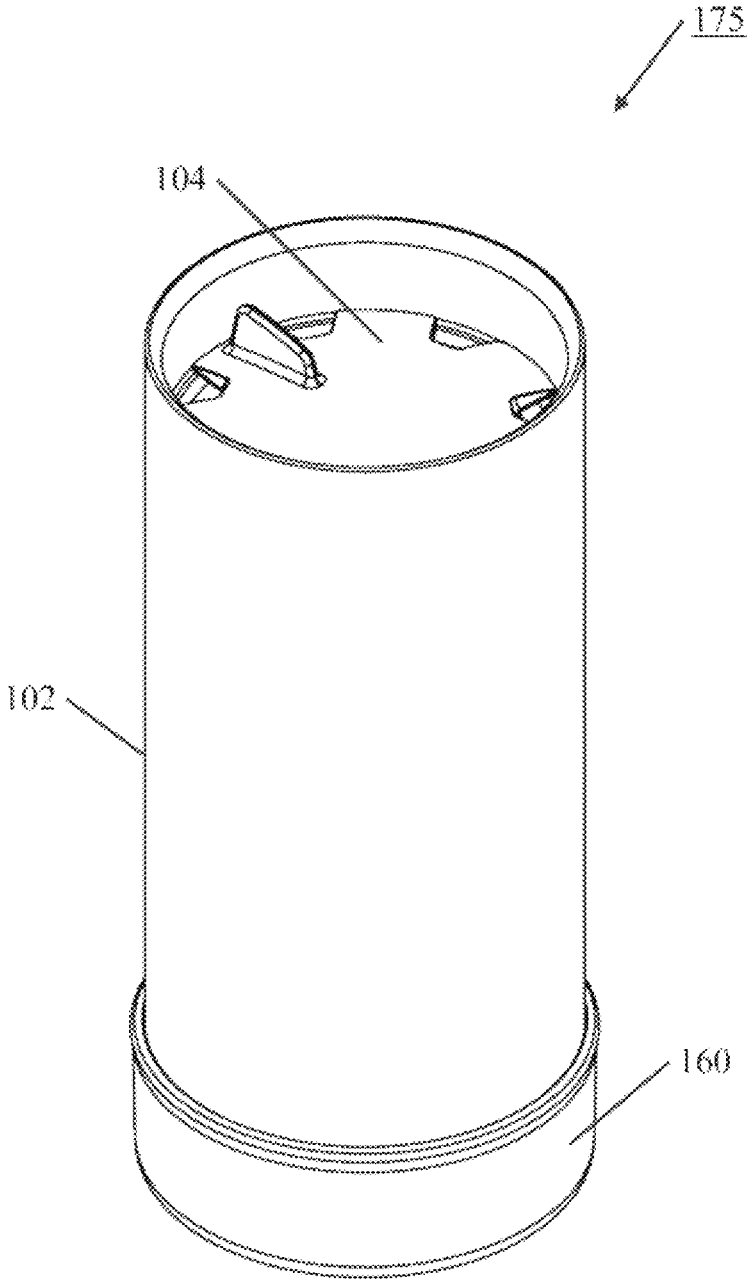
FIG. 5C shows a cover on the base of a drinking set in accordance with the present invention.

FIG. 5C shows the drinking set 100 with the cover 160 covering the bottom 121 of cup 102. In this way, a slip resistant cup 175 is created. Since the cover 160 is made from a flexible plastic material, it provides not only a non slip surface, but also acts as an insulating coaster to protect underlying surfaces from moisture.

Figure 6:
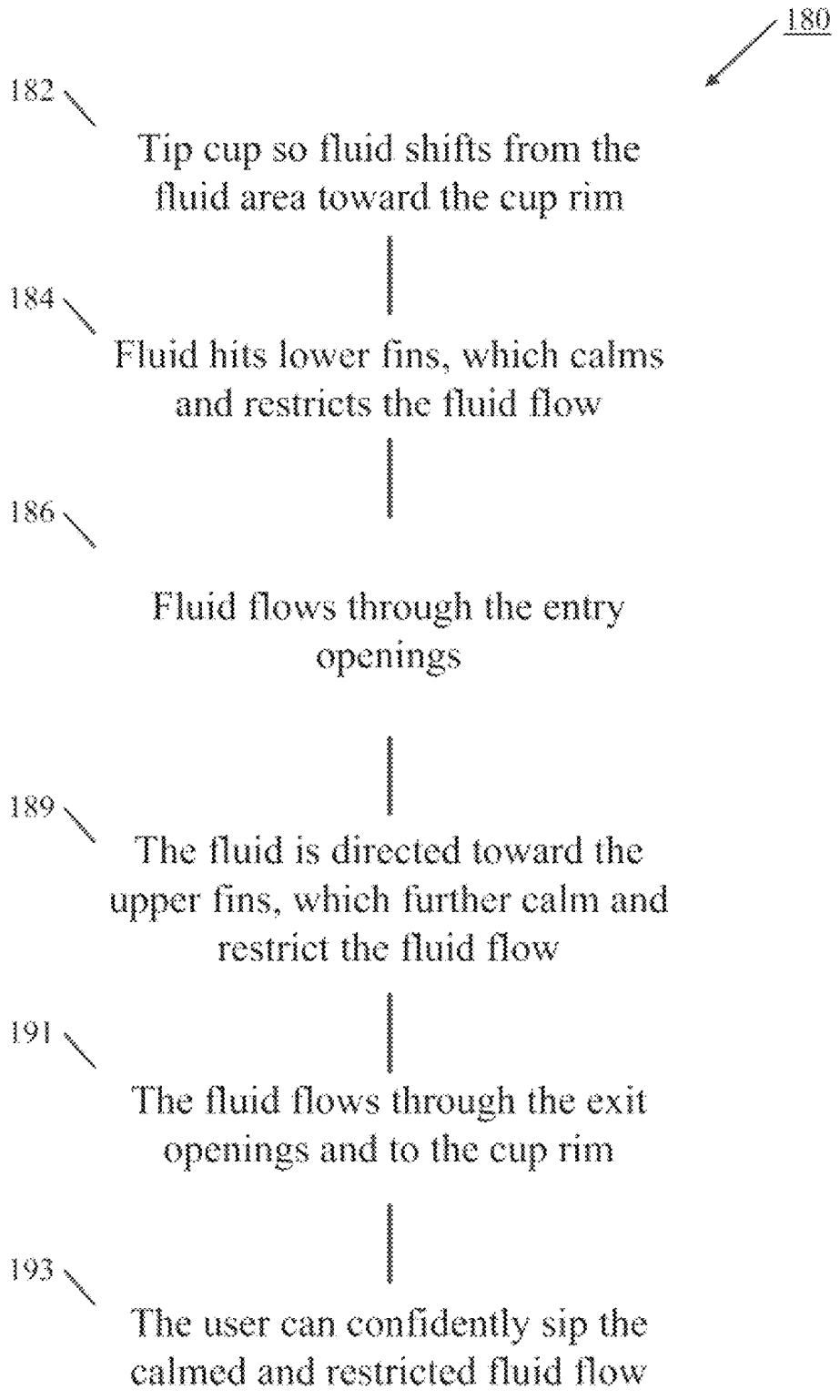
FIG. 6 is a flowchart showing the tortured fluid flow provided by a drinking set in accordance with the present invention.

Referring now to FIG. 6, a flowchart 180 of a tortured fluid path is described. In this example, a user has placed a volume of fluid into the fluid area 119 of a cup 102, and placed the fluid control lid 104 against the step protrusion 113 such that the exit fins 131 are frictionally received against the inner sidewall 111. If present, the user removes the flexible sealing cover 160. As illustrated at block 182, the user tips the cup so the fluid shifts from the fluid area toward the rim of cup 102. The fluid hits the lower entry fins which calms and restricts the fluid flow as illustrated at block 184. Since the lower fins are set at a steep angle with relation to the sidewall, the entry fins act to redirect the inertial energy in any splash or wave within the fluid area 119. In this way, the fluid flowing through the entry openings 134 would be substantially calmed as compared to the fluid within the fluid area 119, as illustrated in block 186. As the user continues to tip the cup, the fluid flows from the entry openings 134 toward the upper exit fins 131, with a substantial portion of the fluid energy directed to the center of a respective upper fin 131, as illustrated in block 189, which further absorbs and redirects energy in the fluid. The fluid then flows around the exit fins 131, and flows out the exit openings 132 as illustrated in block 191. With the fluid having gone through this tortured fluid path, substantial energy has been removed from the fluid flow, as well as a reduction in volume flow. In this way, the user can then confidently sipped the liquid without fear of spilling as illustrated at block 193.

Figure 7:
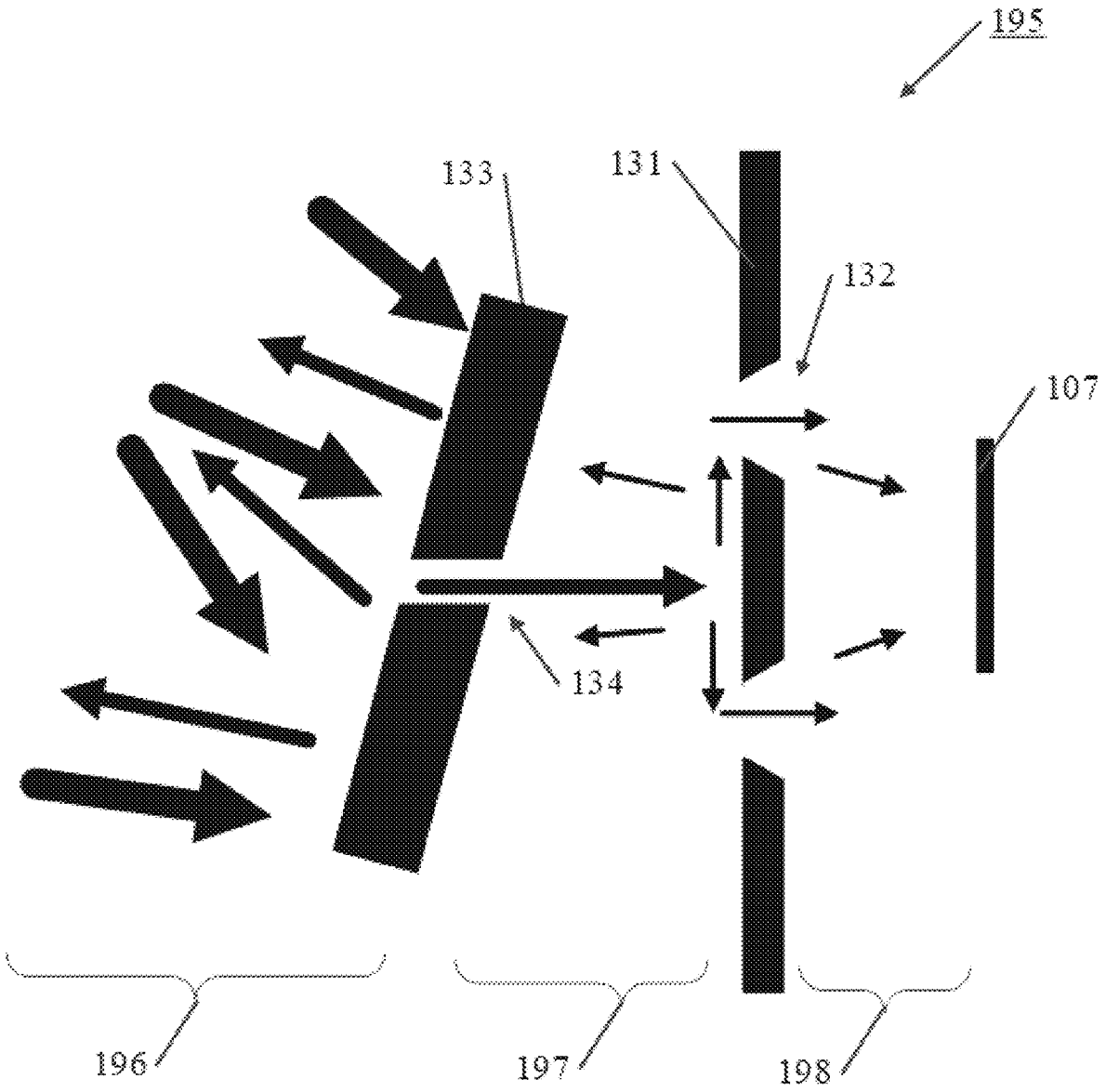
FIG. 7 is a block diagram illustration of a tortured fluid flow in accordance with the present invention.

Referring now to FIG. 7, a block diagram illustration is shown for a tortured fluid flow, such as the tortured fluid flow created by flow control lid 104. FIG. 7 is for illustrative purposes only, and is not intended to reflect actual angles and structural relationships for the flow control lid 104. Tortured path 195 has coffee in a fluid area 196, which is inside a cup, such as cup 102, and set below a flow control lid such as flow control lid 104. When the user tips the cup and begins the sipping process, the cup 102 may experience a sudden jostle or bump. In this way the coffee becomes highly energetic and agitated as illustrated by the large black arrows in the fluid area 196. The highly agitated and energetic sloshing coffee first strikes the entry fins 133. In this way, entry fin 133 absorbs some of the energy from the coffee, and reflects and redirects some of the coffee and its energy back into the cup. This reflected and redirected coffee and energy acts to calm the coffee within fluid area 196, as well as restricting the amount of energy that can pass through entry opening 134. Entry opening 134 is also quite small, so the volume of flowing coffee is also reduced. In this way, entry fins 133 and the entry openings 134 have changed the flow path of the coffee, reduced its energy, and reduced the volume of flow. The coffee now flows into a channel area 197 between the entry fins 133 and the exit fins 131. Due to the arrangement of entry openings 134 to the exit fins 131, the coffee entering the channel area 197 is directed to a solid face of an exit fin 131. Exit fin 131 also absorbs some of the energy from the coffee and reflects some of the coffee and its energy. The coffee is then forced to move around exit fin 131 toward exit opening 132, where the coffee can flow towards the cup rim 107 and the user's lips. In this way, exit fin 131 has changed the flow path of the coffee, reduced its energy, and reduced the volume of flow flowing through exit opening 132. Also, as the exit opening 132 is smaller near the channel 197 and larger toward the cup rim 107, the coffee is also directed to the sidewall 111 of the cup 102.

Accordingly, the flow control disk 104 has caused the flow path to be changed multiple times, the fluid kinetic energy to be reduced multiple times, and the fluid volume to be reduced multiple times. It is this tortured flow path that enables the drinking set 100 to effectively control sloshing and spills, while at the same time delivering a consistent and enjoyable sipping experience.

The drinking set 100 may include enhancements consistent with this disclosure. For example, flow control lid 104 may be constructed of a bacterial resistant material, such as silicone, or may have an embedded or layered antibacterial substance. In one specific example, the silicone can be embedded or coated with nano silver particles, which are known to have an antibacterial effect. It will be understood that other antibacterial substances and coatings could be substituted.

In another example, the flow control lid 104 may include a screen or filter in the exit openings 132. These exit openings 132 may be a separate piece, such as a nylon filter or wire screen, or may be integrally formed from the same material that the disk 105 is made from. Alternatively, a disk or screen may be positioned below the flow control lid 104. The disk or screen could be attached to the base of the lid 104, or could be attached to the bottom of the entry fins 133.

A tether or line could also be attached to the flow control lid 104 to connect the flow control lid 104 to the cup 102. The tether or line could be attached to the handle 135 for example, or could be attached to another area of the flow control lid 104. In another example, a flow-through basket or perforated container could be mounted into the fluid area of the cup 102. In one example, this perforated container or flow-through basket could be attached to the flow control lid 104. In this way, the perforated container or flow-through basket could contain a substance to be mixed with the fluid just prior to drinking. For example, the perforated basket could contain tea or herbal leaves, vitamins, or dietary supplements.

Yet another example the flow control lid 104 could contain a temperature indicator in its top surface for notifying the user of the temperature of the fluid in the fluid area 119. The sensor could, for example, be suspended from the flow control lid 104 into the fluid area, or may sample the air temperature at the base of the flow control lid 104. It will be understood that there are many types of temperature indicators and alarms that could be used.

Additionally, although the described embodiment of drinking set 100 has the flow control lid setting on to the step protrusion 113 and frictionally engaging sidewall 111, it will be understood that other constructions of the flow control lid 104 may snap into place at the step protrusion 113, or may be constructed to rotationally engage and lock into the step protrusion 113.

While particular preferred and alternative embodiments of the present intention have been disclosed, it will be appreciated that many various modifications and extensions of the above described technology may be implemented using the teaching of this invention. All such modifications and extensions are intended to be included within the true spirit and scope of the appended claims.

What is claimed, is:

1. A fluid flow controlled drinking set designed to optimize sipping, comprising:

a cup, comprising:

a bottom, a rigid generally vertical sidewall having an inner face and an outer face, and a smooth drinking lip;

a step protrusion on the inner face such that the cup's inner diameter is smaller below the step protrusion and larger above the step protrusion; and a fluid holding volume beneath the step protrusion;

a unitary flow control lid for insertion into the cup, comprising:

a domed flexible disk having a smooth top that is convexly dome shaped across its diameter;

two sets of vertically overlapping fins integrally formed into the disk, the two sets of fins cooperation to create a tortured flow path for a fluid flowing out of the cup;

the first set of fins setting on the step protrusion and frictionally engaging the inner face of the cup above the step protrusion, the top of the first set of fins forming a portion of the top of the disk;

exit openings between each of the first fins, the exit openings being wider toward the sidewall with the exit openings aggregating to no more than 50% of the inner face circumference above the step protrusion;

the second set of fins extending from the bottom of the flexible disk and angled toward the inner face below the step protrusion; and inlet openings between each of the second fins, the inlet openings offset from the exit openings such that each exit fin overlaps one of the inlet openings, with the inlet openings aggregating to no more than 30% of the inner face circumference below the step protrusion; and wherein the step protrusion is positioned on the inner face so that the top of the flow control lid, when resting on the step protrusion, is fully inside the cup.

2. The drinking set according to claim 1, wherein the disk has domed top such that when the cup's bottom is set on a horizontal surface, liquid on the top of the disk flows toward the outer edge and through the upper openings.

3. The drinking set according to claim 1, wherein the exit openings are shaped generally as trapezoids such that the exit openings are widest at the outer circumference of the disk.

4. The drinking set according to claim 1, wherein each first fin is thicker toward the center of the disk and thinnest at the circumference of the disk.

5. The drinking set according to claim 1, wherein each second fin is thicker toward the center of the disk and thinnest at the circumference of the disk for providing structural integrity for the disk.

6. The drinking set according to claim 1, wherein each of the second fins has a proximal end forming a wall of each respective exit opening and a distal end extending toward the sidewall.

7. The drinking set according to claim 1, wherein each of the second fins has a clearance fit with the inner face below the step protrusion when the flexible disk is installed into the cup.

8. The drinking set according to claim 1, wherein the second set of fins forms an angle at the sidewall of between 30 and 50 degrees.

9. The drinking set according to claim 1, wherein when the drinking set is set upright on a flat horizontal surface, the exit openings are centered directly under a respective first fin.

10. The drinking set according to claim 1, wherein when the flow control lid has an integrated handle, and the step protrusion is positioned on the inner face so that the top of the handle, when the flow control lid is resting on the step protrusion in the cup, is fully inside the cup.

11. The drinking set according to claim 1, wherein the exit openings aggregate to no more than 40% of the inner face circumference above the step protrusion.

12. The drinking set according to claim 1, wherein the inlet openings aggregate to no more than 30% of the inner face circumference below the step protrusion.

13. The drinking set according to claim 1, wherein the exit openings have an area that is about double the area of the inlet openings and have a clearance fit.

14. The drinking set according to claim 1, further including a flexible cover that is sized to be sealably engaged against the outer face of the cup.

15. The drinking set according to claim 14, wherein the flexible cover has an extended sidewall such that when the cover is sealing the cup, the flexible cover extends below the step protrusion.

16. The drinking set according to claim 14, wherein the cup is sized such that the flexible cover frictionally engages the outer face at the bottom of the cup, thereby providing the cup with a non-slip cover.

17. The drinking set according to claim 1, wherein the flow control lid is a single molded piece.

18. A drinking set, comprising:

a cup for holding a volume of a fluid, the cup having a step protrusion on its inner face;

a flexible disk setting on the step protrusion such that the flexible disk is fully inside the cup;

an upper set of fins integrally formed with the disk and extending from the flexible disk toward the inner face of the cup above the step protrusion, the outermost edge of upper fins engaging the side wall of the cup above the step protrusion;

a set of exit openings formed between respective upper fins, the upper openings being widest at the side wall;

a lower set of fins integrally formed with the disk extending from the flexible disk toward the inner face below the step protrusion, the lower fins not contacting the inner face of the cup;

a set of inlet openings formed between respective lower fins, each inlet opening aligned with and vertically overlapped by a respective one of the upper fins, the lower inlet being substantially smaller than the exit openings; and wherein when the cup is tipped to flow the fluid toward a user, a tortured fluid path is created such that the fluid's inertial flow is forced to change direction multiple times as it flows through the contorted path created by one or more inlet openings, navigates around an upper fin, through one or more exit openings, and then to the cup's lip.

19. The drinking set according to claim 18, wherein there are between 6 and 8 upper fins, and an equal number of lower fins.

20. The drinking set according to claim 18, wherein the exit openings aggregate to no more than 50% of the inner face circumference above the step protrusion.

21. The drinking set according to claim 18, wherein the inlet openings aggregate to no more than 30% of the inner face circumference below the step protrusion.

22. The drinking set according to claim 18, wherein the exit openings have an area that is about double the area of the lower openings and has a clearance fit.

* * * * *